US006496680B2

(12) United States Patent
Fujimoto et al.

(10) Patent No.: US 6,496,680 B2
(45) Date of Patent: Dec. 17, 2002

(54) IMAGE FIXING DEVICE AND METHOD USING ULTRASONIC VIBRATION

(75) Inventors: Keisuke Fujimoto, Hirakata (JP); Yoshitaka Kitaoka, Osaka (JP); Masaichiro Tatekawa, Minoo (JP); Masahiko Hashimoto, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/783,355

(22) Filed: Jul. 23, 2001

(65) Prior Publication Data

US 2002/0025200 A1 Feb. 28, 2002

(30) Foreign Application Priority Data

Feb. 16, 2000 (JP) ..... 2000-037703
Mar. 10, 2000 (JP) ..... 2000-066728

(51) Int. Cl.[7] ..... G03G 15/20
(52) U.S. Cl. ..... 399/329
(58) Field of Search ..... 399/302, 320, 399/324, 329, 330, 331, 333, 328, 335; 219/216, 469, 619; 432/60

(56) References Cited

U.S. PATENT DOCUMENTS 4,568,275 A * 2/1986 Sakurai ..... 432/60
5,339,147 A 8/1994 Snelling et al. ..... 399/333
5,390,013 A 2/1995 Snelling ..... 399/328
5,671,473 A * 9/1997 Yamada et al. ..... 399/320
5,765,084 A * 6/1998 Asada et al. ..... 399/302
6,246,035 B1 * 6/2001 Okuda ..... 399/330

FOREIGN PATENT DOCUMENTS

| | | |
|---|---|---|
| JP | 52-94139 | 8/1977 |
| JP | 56-99368 | 8/1981 |
| JP | 60-36663 | 3/1985 |
| JP | 60-91378 | 5/1985 |
| JP | 7-199704 | 8/1995 |
| JP | 11-316518 | * 11/1999 |

* cited by examiner

*Primary Examiner*—Hoan Tran
(74) *Attorney, Agent, or Firm*—Jordan and Hamburg LLP

(57) ABSTRACT

Device and method for fixing an image in which a vibrator, which generates ultrasonic waves by applying a voltage, and a horn connected thereto are arranged opposite a pressure roller with an endless belt passing between the horn and the pressure roller. Recording paper is carried between the belt and the pressure roller so that an image surface thereof is brought into contact with a rubber layer on the endless belt. Ultrasonic vibration is transmitted to the image surface of the traveling recording paper via the belt, thereby directly heating and melting toner so that the image is fixed on the recording paper.

64 Claims, 6 Drawing Sheets

IMAGE FIXING DEVICE AND METHOD USING ULTRASONIC VIBRATION

BACKGROUND OF THE INVENTION

1. Technical Field of the Invention

The present invention relates to a device and a method for fixing an image on recording paper in an image forming apparatus such as a copying machine, facsimile, printer or the like.

2. Description of Related Art

Processing performance of an image forming apparatus such as a printer, facsimile, copying machine or the like for use in an office has been rapidly improved in recent years. Image forming apparatus uses electrophotographic technology to form a toner image on recording paper, and the toner image is fused in a fixing device by applying heat and pressure thereto. A fixing device generally includes a roller heated by a heater and a pressure roller, and recording paper having a toner image thereon is passed through between these rollers, so that toner is melted by heat conduction and fixed on the recording paper.

A pressure-fixing device is also known, in which toner composed of special material, such as paraffin, wax or the like, whose viscosity changes by pressure is squashed under high pressure (normally 15–30 kg/cm) so as to achieve the fixation thereof on recording paper.

As a modification of this pressure-fixing device, Japanese Laid-Open Patent Application No. Sho 52-94139 discloses a fixing device which uses vibration pressure generated in a pair of fixing rollers to fix a toner image on paper. Japanese Laid-Open Patent Application No. Sho 56-99368 discloses a method in which recording paper holding unfixed toner thereon is inserted between an ultrasonic vibrator and a platen to heat and fix the toner by directly applying impact forces. Japanese Laid-Open Utility Model Application No. Sho 60-36663 discloses a fixing method using a heating roller heated by applying ultrasonic vibration. Japanese Laid-Open Patent Application No. Sho 60-91378 discloses a fixing method in which a rotor is provided in a housing and vibration is transmitted to recording paper by the rotor.

In a method using a heating roller heated by a heater, toner is melted to exhibit adhesion so that the toner adheres to recording paper to achieve the fixation thereof. However, most of the applied heat energy is consumed for a loss as radiant heat from the heating roller, a temperature rise of the recording paper, and for evaporation of moisture contained in the recording paper. Thus energy is wasted much more than is used for melting toner, which is the original purpose.

Also, because of its high heat capacity and poor heat transfer efficiency resulting therefrom, it takes long to heat the heating roller, which poses the problem of long standby time after turning on the power. For this reason, various approaches are being adopted to reduce the heat capacity of a fixing device. For example, it has been proposed to provide a stationary heat generator inside a heat resistant film and a pressure roller for pressing the heat generator. However, the heat conduction method inherently involves consumption of energy that is not used for the fixing purpose as described above, and in this regard a reduction in required energy is achieved only to a limited extent. Moreover, a temperature rise inside the device is unavoidable because of the heat source disposed within the device.

The pressure-fixing method has advantages that it is energy-saving, and does not need any standby time. On the other hand, because of the use of high pressure, problems arise that the device is upsized, thereby increasing the weight and cost, strong gloss remains on an image, impact noises occur when recording paper is discharged and so forth.

A fixing device utilizing impact pressure such as ultrasonic vibration has another problem of early deterioration of bearings for supporting rollers, to which vibration is transmitted. There is also a problem of noises that may occur due to ultrasonic vibration. Application of ultrasonic vibration often causes toner to scatter, whereby image quality may be degraded. For these reasons, the ultrasonic vibration method has not yet been put in practical use.

SUMMARY OF THE INVENTION

The present invention has been devised in light of the above-described problems encountered by the prior art, and it is an object of the invention to provide a compact image fixing device using ultrasonic vibration which achieves high energy efficiency and high image quality, and an image fixing method using the same.

To achieve the above object, an image fixing method according to one embodiment of the present invention includes the steps of generating ultrasonic vibration, moving recording paper while bringing an image forming surface of the recording paper into close contact with an outer peripheral surface of an endless belt coated with a rubber layer and transmitting the ultrasonic vibration to the image forming surface of the traveling recording paper via the belt.

A fixing method according to another embodiment of the present invention includes the steps of generating ultrasonic vibration, converting the generated ultrasonic vibration to progressive waves proceeding in a direction generally in parallel to the recording paper surface, pressing a colorant forming an image between the recording paper and a presser member and transmitting vibration of the progressive waves to the colorant.

These and other objects and characteristics of the present invention will become further clear from the following description with reference to the accompanying drawings.

DETAILED DESCRIPTION OF THE PREFERRED EMBODIMENTS

Figure 1:
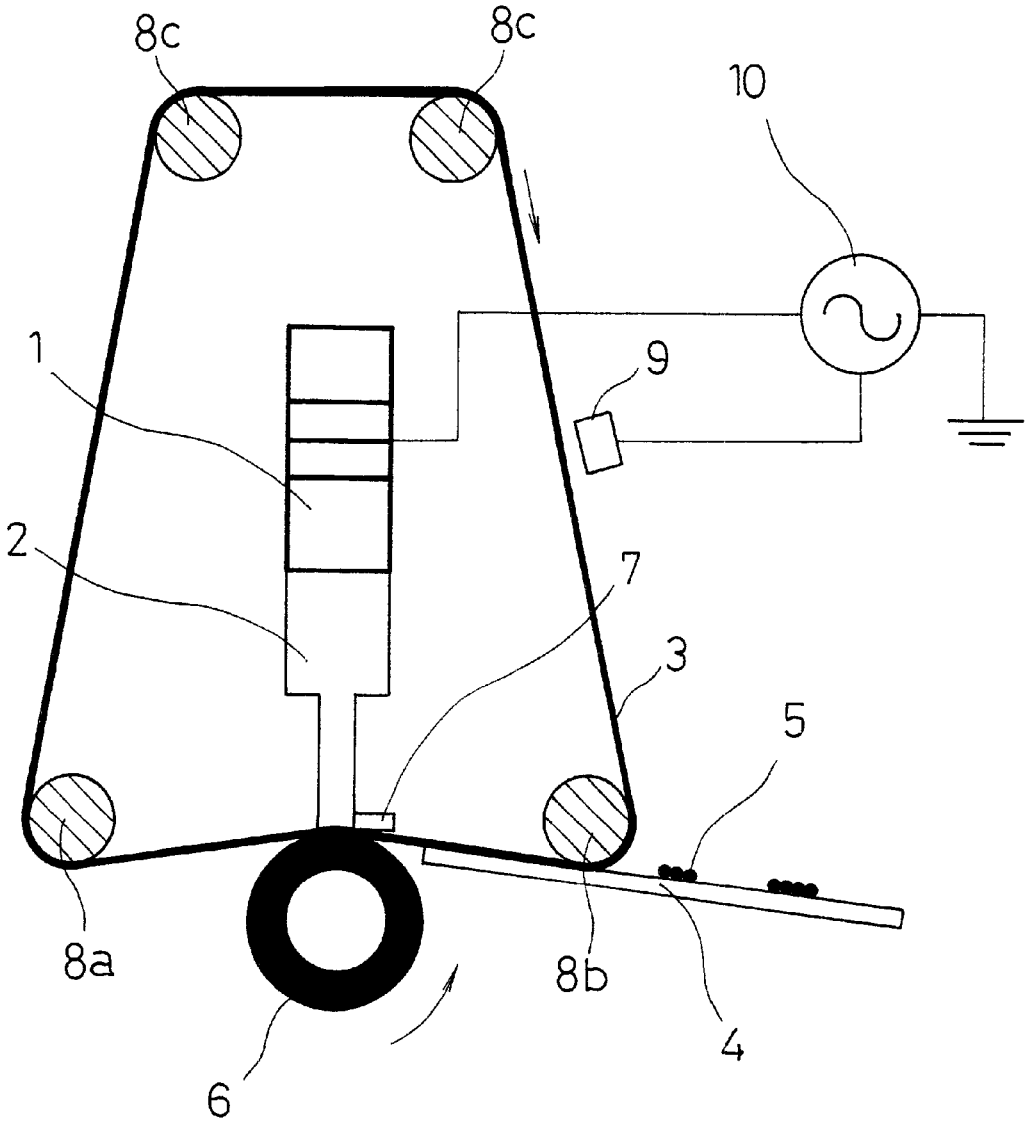
FIG. 1 is a longitudinal cross-sectional view schematically showing a fixing device according to one embodiment of the present invention.

In FIG. 1, reference numeral 1 denotes a bolted Langevin type ultrasonic vibrator (hereinafter referred to as vibrator), which is an ultrasonic vibration source. The vibrator includes PZT (lead zirconate titanate) interposed in a middle portion thereof. When a voltage having the same frequency as a resonance frequency (for example, 40 kHz) of the vibrator is applied to the PZT from a drive circuit 10, the vibrator resonates due to electrostriction of the PZT and electrical energy is converted to vibration energy.

The vibrator 1 is connected to a vibration transmitting member (hereinafter referred to as horn) 2 composed of an amplitude amplifier for amplifying the amplitude of the generated ultrasonic vibration and transmitting the vibration. The horn 2 is formed in a length corresponding to the width of the recording paper 4 in a direction orthogonal to the direction in which the recording paper 4 travels and has the same resonance frequency as that of the vibrator 1. The area of the horn 2 is gradually reduced from a vibration energy input side connected to the vibrator 1 towards an output side so that the amplitude of vibration is amplified.

Figure 2:
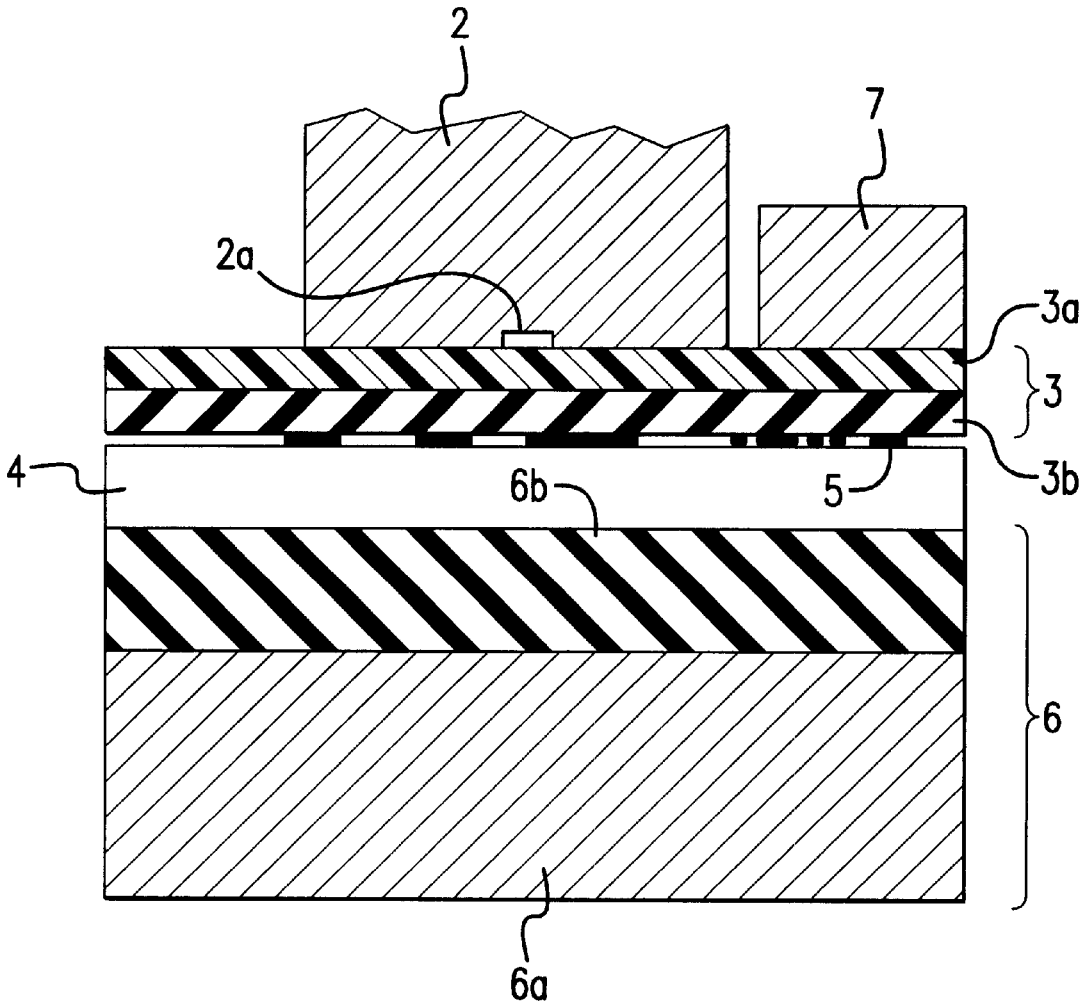
FIG. 2 is an enlarged section of a substantial part in this embodiment.

Indentations 2*a* such as slits or the like are formed at an end of the horn 2 as shown in FIG. 2. Radiation of ultrasonic waves is partially concentrated surrounding the indentations at the end of the horn 2. Consequently, a temperature rise is concentrated, thereby resulting in efficient fixation.

The vibrator 1 and the horn 2 are composed of metallic material such as aluminum alloy, stainless steel, titanium alloy or the like. In this embodiment, aluminum alloy having favorable processability is used. The length of the vibrator 1 and the horn 2 in a vibration direction is generally the same as the half-wave length of vibration and is determined by the sound velocity c and the vibration frequency f of the used material. For example, the length L of a half-wave length resonant rod composed of aluminum alloy having a resonance frequency of 40 kHz is $L=c/(2f)=65$ mm since the sound velocity c is about $5.2\times10^6$ mm/s. The thickness of the end of the horn 2 (nip width in the recording paper 4 traveling direction) is preferably about 2–5 mm due to a traveling speed of the recording paper 4 required to secure a prescribed fixation time for the traveling recording paper 4. In this embodiment, the thickness is set to be 3 mm.

The vibrator 1 and the horn 2 are disposed so as to be encompassed by an endless belt 3. The belt 3 is stretched surrounding four rollers disposed generally in a square shape, that is, a drive roller 8*a* and a guide roller 8*b* disposed along a traveling path of the recording paper 4 and a pair of tension rollers 8*c* also serving as guide rollers. The belt is rotated by the drive roller 8*a* clockwise in a direction indicated by an arrow in FIG. 1 while a certain tension is applied by the tension rollers 8*c*. The recording paper 4 is carried while being brought into close contact with the outer surface of the presser belt 3 so that an image of a powder colorant (hereinafter, referred to as toner) 5 attached to the surface thereof is not disturbed.

The belt 3 is constituted by a substrate 3*a* and a rubber layer 3*b* covering the outer peripheral surface thereof. Since the substrate 3*a* has a function of transmitting vibration from the horn 2 to the toner 5 on the recording paper 4, the substrate is preferably as thin as possible so as not to reflect the vibration. As material therefor, a resin having high heat resistance, for example, such as polyimide, polyarylate, polyamide, silicon rubber, PFA or the like is used so that it does not deform or degrade due to heat upon fixation.

The rubber layer 3*b* has a function of fixing an image by confining the toner 5 on the recording paper 4 and a function of generating heat by absorbing part of ultrasonic vibration energy. The rubber layer 3*b* is composed of silicon rubber having high heat resistance. The thickness thereof is made greater than the amplitude of vibration at the end of the horn 2. Therefore, vibration energy is efficiently converted to heat energy and thus the rubber layer 3*b* is rapidly heated. The toner 5 is efficiently melted by this heat and fixed on the recording paper 4. On the other hand, the rubber layer 3*b* needs to be thin enough to directly transmit the vibration energy to the toner 5.

Specifically, the substrate 3*a* of the belt is preferably about 40–150 $\mu$m in thickness. The rubber layer 3*b* is preferably about 20–100 $\mu$m in thickness. In this embodiment, the substrate 3*a* is composed of polyimide having a thickness of 50 $\mu$m. The rubber layer 3*b* is composed of silicon rubber having a thickness of 40 $\mu$m.

A pressure roller 6 for supporting the recording paper 4 from the backside thereof is disposed at a position opposed to the end of the horn 2 with the belt 3 interposed therebetween. The pressure roller 6 is pressed towards the end of the horn 2 by pressing means (not shown). Instead of allowing the single pressure roller 6 to function as both supporting means and pressing means, a supporting roller as supporting means may be disposed in a fixed manner and pressing means for pushing the vibrator 1 and the horn 2 towards the supporting roller side may be separately provided. In this embodiment, the thrust of the pressure roller 6 is set to be 2 kg/200 mm.

The pressure roller 6 is provided with a rubber layer 6*b* composed of silicon rubber having a thickness of about 2–5 mm, 3 mm in this embodiment, on the outer periphery of the roller body 6*a* of stainless steel so that the pressing force is uniformly applied on the horn 2. Silicon rubber is preferable because of its high heat resistance, and the rubber hardness thereof is preferably 70 degrees or lower (in accordance with Japanese Industrial Standards K6301 A scale). In this embodiment, silicon rubber having hardness of 40 degrees is selected. This is because noises occur upon vibration and a proper range of thrust enabling fixation is made narrow if excessively hard rubber is used. Since the pressure roller 6 is coated with a rubber layer 6*b* having appropriate hardness as described above, the toner 5 and the belt 3 are brought into close contact with each other even when the horn 2 is not sufficiently flat. Thus, the toner 5 does not scatter and thereby uniform fixation is achieved properly. In particular, the rubber hardness is 70 degrees or lower, so that a wide range of pressure can be applied by the pressure roller 6.

The pressure roller 6 has the same resonance frequency as the vibration frequency applied thereto. Wave motions of vibration transmitted from the horn 2 to the pressure roller 6 via the belt 3 and the recording paper 4 are reflected to the horn 2 side. Therefore, the vibration energy is used efficiently.

A rod-like member 7 is contacted to the inner surface of the belt 3 at a position upstream of the position where the horn 2 is in contact with the belt 3 in a direction in which the recording paper 4 travels, in order to prevent vibration from being transmitted to the belt 3 other than the portion to which the horn 2 is contacted. The rod-like member 7 has appropriate rigidity and extends in the width direction of the belt 3 so as to make pressure contact with the belt 3. The distance between the horn 2 and this rod-like member 7 is not longer than a quarter of the wavelength of the transverse wave vibration generated in the belt 3 by application of vibration.

Therefore, no vibration is transmitted to the upstream side in the traveling direction of the recording paper 4. Consequently, the toner 5 before fixation is prevented from scattering.

The belt 3 is moved by a plurality of rollers such as the drive roller 8*a* and the like without slipping or meandering. Since the temperature of the belt 3 slightly rises along with fixing operation, the material of the rollers is preferably metallic material having a high heat conductivity such as stainless steel, aluminum or the like. To prevent a slip of the belt 3 by increasing frictional forces, the surface of the drive roller 8*a* may be roughened by sandblasting or coated with urethane rubber, silicon rubber or the like.

A sensor 9 for detecting movement of the belt 3 is disposed at an appropriate site on the moving path thereof. The sensor 9 is connected to the drive circuit 10 of the vibrator 1. If the belt 3 stops due to a slip or the like, the driving of the vibrator 1 is stopped. Therefore, the temperature of the belt 3 does not rise excessively and damage to the belt 3, horn 2 and pressure roller 6 is prevented.

Although not shown, means for coating the outer surface of the belt 3 with silicon oil may be disposed as required. Thereby, offset of the toner 5 to the belt 3 can be prevented and scattering of toner 5 can be more effectively prevented by the viscosity of oil.

An image is fixed as follows. In a preceding image forming process, recording paper 4 on which toner 5 is attached by electrostatic attraction to form an image is fed by an appropriate guide (not shown) from the right hand side in FIG. 1. While the recording paper 4 travels, the surface thereof is brought into close contact with the outer surface of the belt 3 at a position before a nip portion between the horn 2 and the pressure roller 6. Subsequently, ultrasonic vibration is applied to the front face of the recording paper 4 from the end of the horn 2 via the belt 3 while the back surface thereof is supported and pressed towards the end of the horn 2 by the pressure roller 6. Thereupon, vibration energy is converted to heat energy by internal distortion of the toner 5. Thus the toner 5 is directly heated up, melted, and fixed on the recording paper 4.

According to this fixation process, since the toner 5 on the recording paper 4 is pressed by the rubber layer 3*b* of the belt 3 surface having viscoelasticity, scattering of the toner 5 due to vibration is reliably prevented before the toner 5 is melted and fixed. Since the thickness of the rubber layer 6*b* covering the pressure roller 6 is greater than the amplitude of vibration at the end of the horn 2, no gap is generated between the horn 2 and the pressure roller 6 by application of vibration and thereby the toner 5 does not scatter in the nip portion as well. Thus, high image quality is ensured.

As described above, since toner 5 is directly heated and fixed, not by heat conduction, a loss as radiant heat is reduced and energy is saved. Since vibration is transmitted from the side of the belt 3 which is thin, the vibration is efficiently transmitted to the toner 5 regardless of the type of the recording paper 4 or ambient condition. Thus the present invention provides a constant and highly reliable fixing device.

Figure 3:
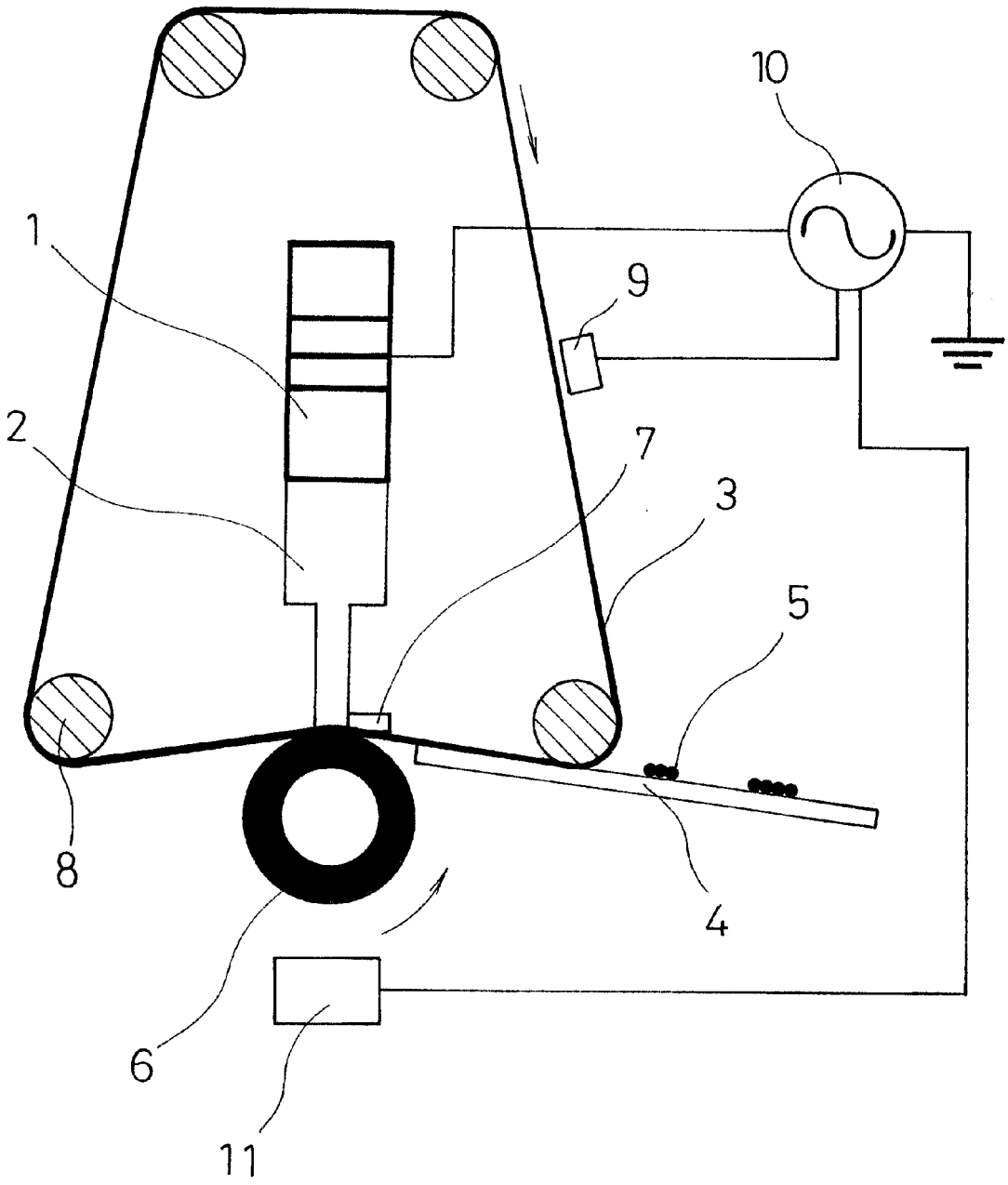
FIG. 3 is a longitudinal sectional view showing a schematic construction of a modification of this embodiment.

Designs of the fixing device of the present invention described above can be altered in various ways. FIG. 3 shows a modification of the above embodiment.

In this modification, a sensor 11 for detecting rotation of the pressure roller 6 is provided in addition to the constitution of FIG. 1. The sensor 11 is connected to the drive circuit 10 of the vibrator 1 and is controlled so that the driving of the vibrator 1 is stopped should the pressure roller 6 stop rotating.

Therefore, an excessive temperature rise of the pressure roller 6 is prevented because, during the pressure roller 6 is at a halt, the vibrator 1 is also stopped. Damage to the pressure roller 6, belt 3 and horn 2 is thereby reliably prevented.

Figure 4:
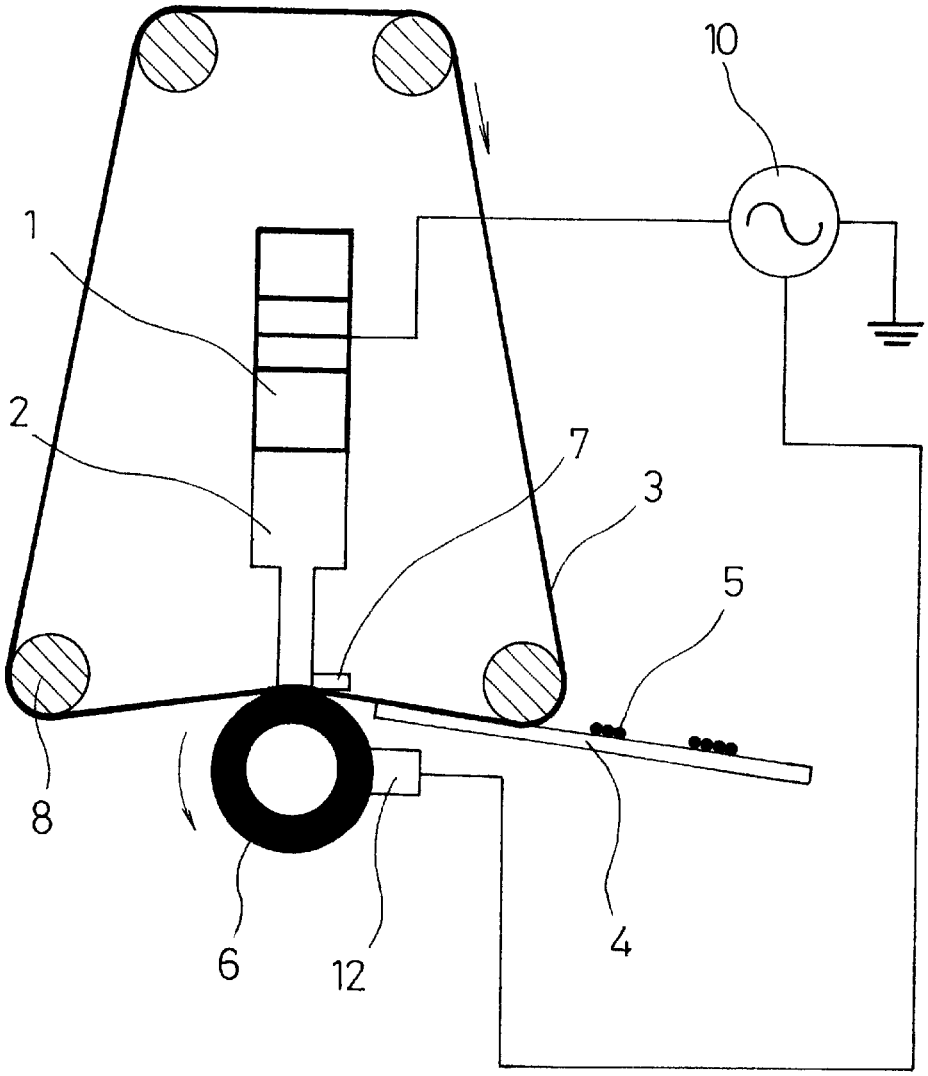
FIG. 4 is a longitudinal sectional view showing a schematic construction of another modification of this embodiment.

FIG. 4 shows another modification of the above embodiment. In this modification, a sensor 12 for detecting the surface temperature of the pressure roller 6 is provided in addition to the constitution of FIG. 1. The sensor 12 is connected to the drive circuit 10 so that the amount of vibration energy to be inputted to the vibrator 1 is controlled depending on the detected temperature. It is needless to say that the surface temperature of the belt 3 or both the pressure roller 6 and the belt 3 may be detected instead of that of the pressure roller 6.

In this modification, the belt 3 is rotated one turn or more while the vibrator 1 is operated by the drive circuit 10 before the recording paper 4 reaches the nip portion where the horn 2 and the pressure roller 6 make pressure contact with each other via the belt 3. Consequently, the belt 3 and the pressure roller 6 are preheated since part of heat generated by vibration energy of the vibrator 1 remains in the belt 3 and the pressure roller 6. Therefore, electrical energy inputted at an initial stage of fixation on the recording paper 4 can be reduced, while ensuring that each recording paper 4 is uniformly heated for the fixation. The surface temperatures of the belt 3 and the pressure roller 6 are detected by the sensor 12 and the amount of vibration energy to be inputted to the vibrator 1 is controlled depending on these temperatures so that an optimal temperature for fixation is obtained. Thus energy is saved without degrading reliability.

In the above description of the embodiment, a colorant for forming an image on recording paper 4 is composed of powder toner as an example. Similar effects will be obtained if a film is used instead of powder toner.

Figure 5:
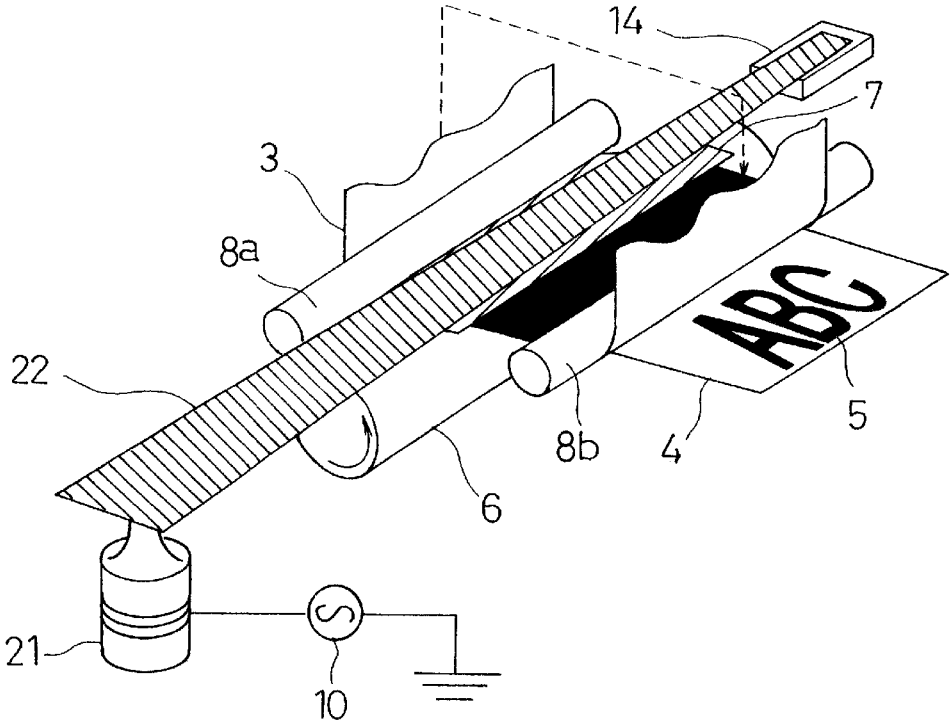
FIG. 5 is a perspective view schematically showing a fixing device according to another embodiment of the present invention.
Figure 6:
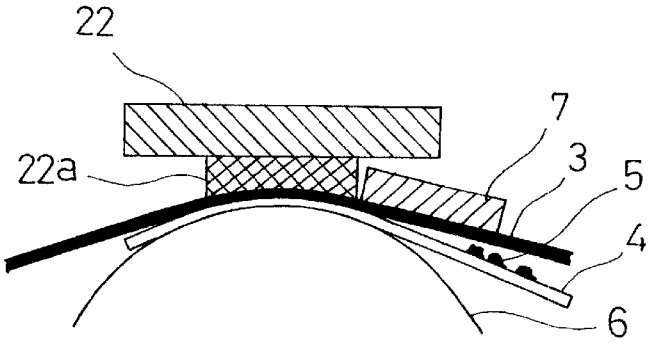
FIG. 6 is an enlarged longitudinal section of a substantial part in this embodiment.

Another embodiment of the present invention will be described below. FIG. 5 is a perspective view showing a fixing device of a second embodiment. FIG. 6 is a cross section of a substantial part of this fixing device. In this figure, like components are designated. by like reference numerals in the above embodiment and detailed description thereof is omitted.

Reference numeral 21 denotes a vibration source composed of a bolted Langevin type ultrasonic vibrator. Reference numeral 22 denotes a vibration transmitting member for amplifying the amplitude of ultrasonic vibration generated by the vibrator 21. The vibration transmitting member 22 is composed of a beam-like member having a rectangular cross section and disposed above the traveling path of the recording paper 4, generally in parallel to the recording paper 4 surface in a direction perpendicular to the traveling direction thereof. The vibrator 21 is connected to one end of the vibration transmitting member 22 on one side in a direction perpendicular to the traveling path of the recording paper 4. A damping rubber 14 composed of a substance having viscoelasticity such as silicon rubber for absorbing vibration is connected to the other end of the vibration transmitting member 22 on the other side in the direction perpendicular to the traveling path of the recording paper 4. When a voltage is applied to the vibrator 21 from a vibration power source 10, progressive waves transmitted in a direction generally in parallel to the recording paper 4 surface are formed in the vibration transmitting member 22. A linear vibration transmitting plate 22*a* is provided in a portion opposed to the recording paper 4 surface on the lower surface of the vibration transmitting member 22. The vibration transmitting member 22 is formed so that the width thereof gradually becomes narrower from the vibrator 21 side towards the damping rubber 14. On the other hand, the width of the vibration transmitting plate 22*a* is constant.

Reference numeral 3 denotes an endless belt which is moved by the drive roller 8*a* and the guide roller 8*b* (only part thereof is shown) along a moving path encompassing the vibration transmitting member 22. The recording paper 4 is carried while being brought into close contact with the outer surface of the belt 3. The constitution of the belt 3 is the same as in the above first embodiment.

A pressure roller 6 for supporting the recording paper 4 from its backside and for pressing same towards the vibration transmitting plate 22*a* is disposed as opposed to the vibration transmitting plate 22*a* with the belt 3 being interposed therebetween. The constitution of the pressure roller 6 is the same as in the above first embodiment. Instead of the pressure roller, a fixed supporting roller may be disposed below the belt 3 and movable pressing means may be provided to press the vibration transmitting member 22 towards the supporting roller. The lower surface of the vibration transmitting plate 22*a* is formed in an arcuate concave shape along the outer peripheral surface of the roller so that a wide nip portion is secured.

An image is fixed as follows. In a preceding image forming process, recording paper 4 on which toner 5 is attached by electrostatic attraction to form an image is fed by an appropriate guide (not shown). While the recording paper 4 travels, the surface thereof is brought into close contact with the outer surface of the belt 3 at a position before the nip portion between vibration transmitting member 22 and the pressure roller 6. Subsequently, vibration by the progressive waves transmitted in the vibration transmitting member 22 is applied to the front face of the recording paper 4 from the lower surface of the vibration transmitting plate 22*a* via the belt 3 while the back face thereof is supported and pressed towards the vibration transmitting plate 22*a* by the pressure roller 6. Thereupon, vibration energy is converted to heat energy by internal distortion of the toner 5. Thus the toner 5 is directly heated up, melted, and fixed on the recording paper 4.

The width of the vibration transmitting member 22 is made narrower from one side towards the other side as described above. Consequently, the moment of inertia of area in the vibration transmitting member 22 is changed and rigidity of the vibration transmitting member 22 having a prescribed material constant is gradually reduced from one side to the other side. Thus, the maximum displacement speed generated in the vibration transmitting plate 22*a* becomes constant almost over the entire area. On the other hand, the width of the vibration transmitting plate 22*a* provided on the lower surface of the vibration transmitting member 22 is constant. Therefore, the vibration energy transmitted from the linear vibration transmitting plate 22*a* becomes constant. Thus, uniform fixation is achieved.

As described above, since toner is heated by using progressive waves transmitted in the vibration transmitting member 22 disposed generally in parallel to the recording paper 4 surface, the vibrator 21 for ultrasonic vibration needs to be disposed only on one side of the recording paper 4 traveling path. According to this embodiment, a fixing device can be constituted in a compact size as described above and the degree of freedom in design is improved.

In the above embodiment, the vibration transmitting member 22 having a vibration transmitting plate 22*a* is fixed while the endless belt 3 and the recording paper 4 are moved. In this constitution, amplitude distribution is uniform as compared to a case where a planar vibration transmitting member is used. Since vibration energy is concentrated linearly, the maximum output can be reduced and the vibration transmitting member can be made smaller and lighter. It is needless to say that the constitution of the fixing device can be altered in various ways. For example, the recording paper 4 and the belt 3 may be placed in a fixed manner and the vibration transmitting member 22 and pressure roller 6 may be moved. In another mode, each of the vibration transmitting member 22, belt 3 and pressure roller 6 can be constituted in a planar shape.

Figure 7:
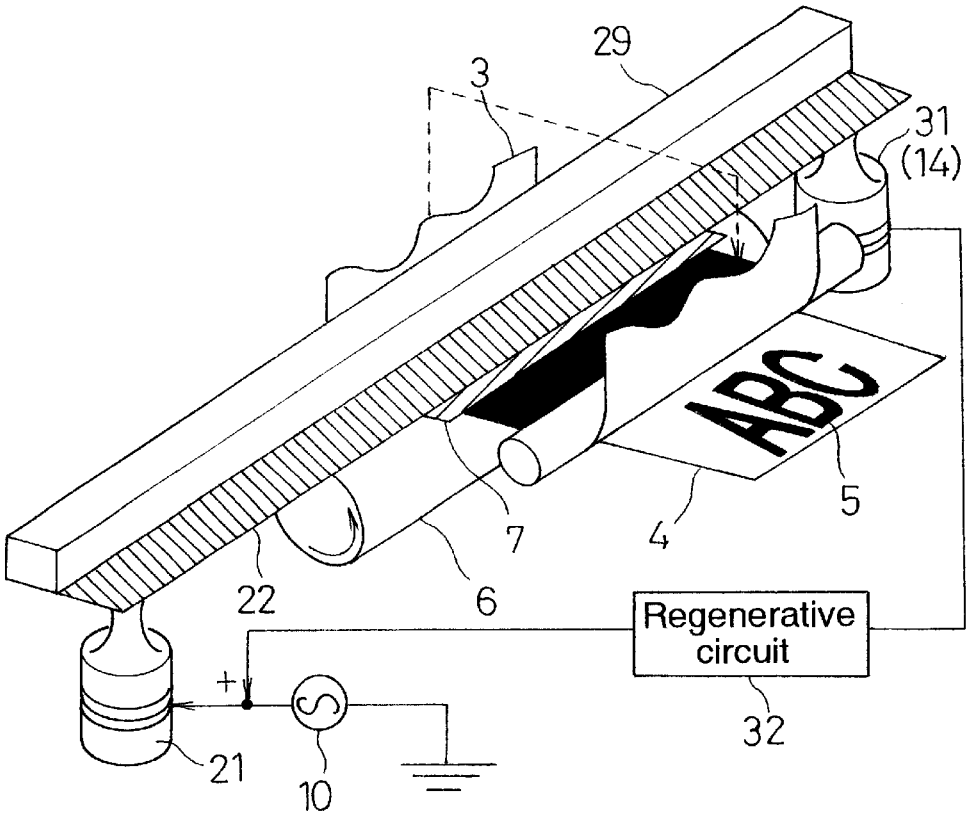
FIG. 7 is a perspective view showing a schematic construction of a modification of this embodiment.
Figure 8:
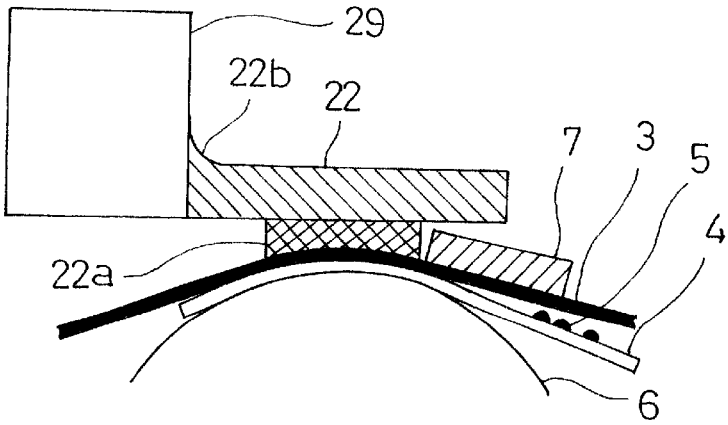
FIG. 8 is an enlarged longitudinal section of a substantial part in this embodiment.

FIGS. 7 and 8 show a modification of the above second embodiment. In this modification, one side in the longitudinal direction of the vibration transmitting member 22 is connected to a block 29 (holding member) composed of a member having high rigidity. The vibration transmitting member 22 and the block 29 are composed of the same material and integrally constructed. A fillet 22*b* is formed at a corner of the connecting portion thereof. While each of the vibration transmitting member 22 and the vibration transmitting plate 22*a* has a constant width, the thickness thereof in the vertical direction is changed from one side to the other side.

Consequently, the rigidity distribution of the vibration transmitting member 22 is changed and the maximum displacement speed of vibration becomes constant.

A vibrator 21 is connected to one end of the vibration transmitting member 22. An ultrasonic vibrator 31 for absorbing vibration and converting the vibration to electricity is connected to the other end. The vibrator 31 is the same as the vibrator 21. Vibration energy transmitted in the vibration transmitting member 22 is converted to electrical energy by the vibrator 31, inputted to a regenerative circuit 32 and recovered.

According to the above constitution, since the vibration transmitting member 22 is supported by the block 29, sufficient pressing forces can be secured between the pressure roller 6 and the vibration transmitting member 22, thereby achieving fixation efficiently. Since a fillet 22*b* is formed at a corner portion where the block 29 and the vibration transmitting member 22 are connected, stress is not concentrated and thereby no damage occurs even after a long-term use. Since the vibration energy generated by the vibrator 21 and transmitted in the vibration transmitting member 22 is converted to electrical energy by the vibrator 31 and recovered, favorable energy efficiency can be obtained.

In the above embodiment, an example where an image is formed by toner 5 on recording paper 4 before fixation has been described. However, an image may be formed by attaching toner 5 on a surface of the belt 3 opposed to the recording paper 4, i.e., the outer peripheral surface of the belt 3 and the image may be transferred and fixed to the recording paper 4.

In the above embodiment, an example where progressive waves transmitted in the vibration transmitting member 22 are transverse waves has been described. It should be noted that compressional waves can also be used. In this case, the cross-sectional area of the vibration transmitting member 22 should preferably be changed to arbitrarily change the rigidity distribution thereof.

Indentations may be formed on the vibration transmitting plate 22*a* of the vibration transmitting member 22 as is the case with the above-described first embodiment, whereby radiation of vibration energy is concentrated on the end of the projected portion, and fixing efficiency is improved. In this case, the distribution of the transmitted vibration energy can be made constant by changing the area density of the indentations depending on the amplitude distribution generated in the vibration transmitting member 22. Even when the rigidity distribution in the vibration transmitting member 22 is uniform, the maximum displacement speed generated in the vibration transmitting plate 22*a* can be made constant and thereby uniform fixation can be performed.

As described above, the fixing method of the present invention saves energy, has no standby time and ensures high image quality in a highly reliable manner. The fixing device of the present invention has a compact construction and has high degree of freedom in design.

It is intended that the specific embodiments of the present invention have been described as above to clarify the technical contents of the invention, but do not limit the technical scope. Various changes and modifications should be construed as included therein unless they depart from the scope of the invention as defined by the following claims.

What is claimed is:

1. An image fixing method comprising:

generating ultrasonic vibration;

directing recording paper with an image forming surface into contact with an outer surface of an endless belt including a substrate and a viscoelastic rubber layer coated on the substrate such that the image forming surface contacts the rubber layer; and transmitting the ultrasonic vibration to the image forming surface of the recording paper via the belt.

2. The fixing method according to claim 1, further comprising the step of preventing vibrations from being transmitted to an upstream side, in a direction in which the recording paper travels, of an area in the recording paper to which vibration is transmitted.

3. The fixing method according to claim 1, further comprising the step of preheating the belt.

4. The fixing method according to claim 1, further comprising the steps of:

monitoring movement of the belt; and stopping the vibration upon detection of stoppage of the belt.

5. The fixing method according to claim 1, further comprising the steps of:

measuring the temperature of the belt; and controlling the vibration based on the temperature of the belt.

6. An image fixing device comprising:

an ultrasonic vibrator;

a vibration transmitting member connected to said ultrasonic vibrator;

an endless belt encompassing said ultrasonic vibrator and said vibration transmitting member, said belt having a substrate and a viscoelastic rubber layer coated on said substrate, said belt being moved such that an image surface of recording paper is brought into contact with said rubber layer;

a supporting member arranged opposite one end of said vibration transmitting member via said belt for supporting a back face of the recording paper on the opposite side of the image surface; and a pressing member for applying pressure in a direction in which said vibration transmitting member and said supporting member approach each other.

7. The fixing device according to claim 6, wherein said rubber layer of said belt has a thickness greater than the amplitude of vibration at one end of said vibration transmitting member.

8. The fixing device according to claim 6, wherein said rubber layer comprises silicon rubber.

9. The fixing device according to claim 6, further comprising a coating of silicon oil arranged on said rubber layer of said belt.

10. The fixing device according to claim 6, wherein said vibration transmitting member includes indentations at one end.

11. The fixing device according to claim 6, wherein said supporting member has the same resonance frequency as an applied vibration frequency.

12. The fixing device according to claim 6, further comprising a rubber layer having rubber hardness of 70 degrees or lower coated on said supporting member.

13. The fixing device according to claim 12, wherein said rubber layer on said supporting member has a thickness greater than the amplitude of vibration at one end of said vibration transmitting member.

14. The fixing device according to claim 6, further comprising a member for preventing transmission of vibration, said member being in contact with said belt at an upstream side of said vibration transmitting member in a direction in which the recording paper travels.

15. The fixing device according to claim 14, wherein said vibration transmitting member and said member for preventing transmission of vibration are spaced from each other at a distance which is a quarter or less of a wavelength of transverse waves generated in said belt by the application of vibration.

16. The fixing device according to claim 6, wherein said belt is made of a heat resistant material, said rubber layer comprising a heat resistant rubber, and said belt being arranged to rotate at least one turn or more before the recording paper reaches a position where vibration is transmitted to the recording paper, with said ultrasonic vibrator and said pressing member being in operation.

17. The fixing device according to claim 6, further comprising:

a sensor for detecting movement of said belt or said supporting member; and a drive circuit for driving said ultrasonic vibrator, said sensor being connected to said drive circuit.

18. The fixing device according to claim 6, further comprising:

a sensor for detecting a surface temperature of said belt or said supporting member; and a drive circuit for driving said ultrasonic vibrator, said sensor being connected to said drive circuit.

19. The fixing-device according to claim 6, wherein the image is formed with colorant in a form of either powder or film.

20. An image fixing method comprising:

generating ultrasonic vibration;

converting the generated ultrasonic vibration to progressive waves proceeding in a direction generally parallel to an imaging forming surface of recording paper;

pressing a colorant forming an image between the recording paper and a presser member; and transmitting vibration of the progressive waves to the colorant.

21. The fixing method according to claim 20, further comprising the step of providing the progressive waves with a constant maximum displacement speed over the entire area in which vibration is transmitted to the colorant.

22. The fixing method according to claim 20, further comprising the steps of:

converting vibration energy to electrical energy; and recovering the electrical energy by means of a vibration absorbing member arranged at one end in a proceeding direction of the progressive waves.

23. The fixing method according to claim 20, wherein the progressive waves are compressional waves transmitted in a direction generally in parallel to the recording paper surface.

24. The fixing method according to claim 20, wherein the progressive waves are transverse waves transmitted generally in parallel to the recording paper surface.

25. An image fixing device comprising:

a vibration source for generating ultrasonic vibration;

a vibration transmitting member disposed in parallel to a surface of a recording paper and connected to the vibration source at one end thereof;

a vibration absorbing member for absorbing vibration at the other end of the vibration transmitting member to form progressive waves in the vibration transmitting member;

a presser member for pressing a colorant forming an image between itself and the recording paper; and a pressure applicator for holding the recording paper and the presser member between itself and the vibration transmitting member.

26. The fixing device according to claim 25, wherein the vibration transmitting member has a vibration transmitting portion, and wherein rigidity distribution of the vibration transmitting member is changed so that the vibration transmitting portion is made to have a constant maximum displacement speed over the entire area thereof.

27. The fixing device according to claim 26, wherein the rigidity distribution of the vibration transmitting member is changed by changing the thickness thereof in a direction perpendicular to the recording paper surface.

28. The fixing device according to claim 25, wherein the vibration transmitting member has a vibration transmitting portion provided with indentations.

29. The fixing device according to claim 28, wherein the vibration transmitting portion has a protruded end of which area density is changed in accordance with the distribution of amplitude of vibration generated in the vibration transmitting member so that transmitted vibration energy is distributed uniformly.

30. The fixing device according to claim 25, wherein the vibration transmitting member is a beam having a linear vibration transmitting portion on a surface opposed to the recording paper, and the vibration transmitting member and the pressure applicator are movable.

31. The fixing device according to claim 30, wherein the vibration transmitting member has its rigidity distribution changed so that the vibration transmitting portion has a constant maximum displacement speed over the entire area in the longitudinal direction thereof, while the vibration transmitting portion making contact with the presser member or the recording paper has a constant width.

32. The fixing device according to claim 31, wherein the progressive waves transmitted in the vibration transmitting member are compressional waves, and changing of the rigidity distribution of the vibration transmitting member is effected by changes in the cross-sectional area of the vibration transmitting member.

33. The fixing device according to claim 31, wherein the progressive waves transmitted in the vibration transmitting member are transverse waves, and changing of the rigidity distribution of the vibration transmitting member is effected by changes in the moment of inertia of area in the cross section of the vibration transmitting member.

34. The fixing device according to claim 30, wherein the vibration is generated in transverse waves which is transmitted in the longitudinal direction of the vibration transmitting member, and wherein the vibration transmitting member is connected to a holding member having high rigidity along one side thereof in its lengthwise direction.

35. The fixing device according to claim 34, wherein the vibration transmitting member and the holding member are integrally formed of the same material, a fillet being formed at a corner of the interface between the vibration transmitting member and the holding member.

36. The fixing device according to claim 25, wherein the vibration transmitting member is a beam having a linear vibration transmitting portion, and wherein the presser member and the recording paper are movable.

37. The fixing device according to claim 36, wherein the presser member is an endless belt.

38. The fixing device according to claim 37, further comprising a member for preventing transmission of vibration, being in contact with the presser member, at an upstream side of the vibration transmitting member in a direction in which the recording paper travels.

39. The fixing device according to claim 36, wherein the pressure applicator is a roller having a curved outer surface in contact with the vibration transmitting portion, the vibration transmitting portion having an arcuate concave surface corresponding to the curved outer surface of the roller.

40. The fixing device according to claim 25, wherein the presser member has a viscoelastic layer formed thereon for making contact with the recording paper.

41. The fixing device according to claim 25, wherein the vibration transmitting member is in contact with the presser member.

42. The fixing device according to claim 25, wherein amplitude of vibration is amplified between the vibration source and the vibration transmitting member.

43. The fixing device according to claim 25, wherein the vibration absorbing member converts vibration energy to electrical energy.

44. An image fixing method, comprising the steps of:

generating ultrasonic vibration;

directing recording paper with an image forming surface into contact with an outer surface of an endless belt including a viscoelastic layer such that the image forming surface contacts the viscoelastic layer; and transmitting the ultrasonic vibration to the image forming surface of the recording paper via the belt.

45. The fixing method according to claim 44, further comprising the step of preventing vibrations from being transmitted to an upstream side, in a direction in which the recording paper travels, of an area in the recording paper to which vibration is transmitted.

46. The fixing method according to claim 44, further comprising the step of preheating the belt.

47. The fixing method according to claim 44, further comprising the steps of:

monitoring movement of the belt; and stopping the vibration upon detection of stoppage of the belt.

48. The fixing method according to claim 44, further comprising the steps of:

measuring the temperature of the belt; and controlling the vibration based on the temperature of the belt.

49. An image fixing device comprising:

an ultrasonic vibrator;

a vibration transmitting member connected to said ultrasonic vibrator;

an endless belt encompassing said ultrasonic vibrator and said vibration transmitting member, said belt having a viscoelastic layer defining an outer surface of said belt, said belt being moved such that an image surface of recording paper is brought into contact with said viscoelastic layer;

a supporting member arranged opposite one end of said vibration transmitting member via said belt for supporting a back face of the recording paper on the opposite side of the image surface; and a pressing member for applying pressure in a direction in which said vibration transmitting member and said supporting member approach each other.

50. The fixing device according to claim 49, wherein said rubber layer of said belt has a thickness greater than the amplitude of vibration at one end of said vibration transmitting member.

51. The fixing device according to claim 49, wherein said rubber layer comprises silicon rubber.

52. The fixing device according to claim 49, further comprising a coating of silicon oil arranged on said rubber layer of said belt.

53. The fixing device according to claim 49, wherein said vibration transmitting member includes indentations at one end.

54. The fixing device according to claim 49, wherein said supporting member has the same resonance frequency as an applied vibration frequency.

55. The fixing device according to claim 49, further comprising a rubber layer having rubber hardness of 70 degrees or lower coated on said supporting member.

56. The fixing device according to claim 55, wherein said rubber layer on said supporting member has a thickness greater than the amplitude of vibration at one end of said vibration transmitting member.

57. The fixing device according to claim 49, further comprising a member for preventing transmission of vibration, said member being in contact with said belt at an upstream side of said vibration transmitting member in a direction in which the recording paper travels.

58. The fixing device according to claim 57, wherein said vibration transmitting member and said member for preventing transmission of vibration are spaced from each other at a distance which is a quarter or less of a wavelength of transverse waves generated in said belt by the application of vibration.

59. The fixing device according to claim 49, wherein said belt is made of a heat resistant material, said rubber layer comprising a heat resistant rubber, and said belt being arranged to rotate at least one turn or more before the recording paper reaches a position where vibration is transmitted to the recording paper, with said ultrasonic vibrator and said pressing member being in operation.

60. The fixing device according to claim 49, further comprising:

a sensor for detecting movement of said belt or said supporting member; and a drive circuit for driving said ultrasonic vibrator, said sensor being connected to said drive circuit.

61. The fixing device according to claim 49, further comprising:

a sensor for detecting a surface temperature of said belt or said supporting member; and a drive circuit for driving said ultrasonic vibrator, said sensor being connected to said drive circuit.

62. The fixing device according to claim 49, wherein the image is formed with colorant in a form of either powder or film.

63. An image fixing apparatus comprising:

an endless belt movable such that an image forming surface of recording paper is brought into contact with an outer surface of said belt;

a vibration generating and transmitting member for generating vibrations and transmitting the vibration to the image forming surface of the recording paper via said belt; and a member for preventing transmission of vibrations, said member for preventing transmission of vibrations being arranged to prevent transmission of vibrations from said belt to an upstream side in a direction in which the recording paper travels.

64. An image fixing apparatus comprising:

an endless belt movable such that an image forming surface of recording paper is brought into close contact with an outer surface of said belt;

a vibration generating and transmitting member for generating vibrations and transmitting the vibration to the image forming surface of the recording paper via said belt; and a member for preventing transmission of vibrations, said member for preventing transmission of vibrations being in contact with said belt at an upstream side of said vibration generating and transmitting member in a direction in which the recording paper travels, said member for preventing transmission of vibration being arranged to prevent transmission of vibrations from said belt to the upstream side.

* * * * *

UNITED STATES PATENT AND TRADEMARK OFFICE

CERTIFICATE OF CORRECTION

PATENT NO. : 6,496,680 B2
DATED : December 17, 2002
INVENTOR(S) : Keisuke Fujimoto et al.

It is certified that error appears in the above-identified patent and that said Letters Patent is hereby corrected as shown below:

Title page,
Item [22], please correct the filing date from:
"[22] Filed: Jul. 23, 2001" to
-- [22] Filed: Feb. 14, 2001 --.

Signed and Sealed this

Twenty-eighth Day of October, 2003

JAMES E. ROGAN
*Director of the United States Patent and Trademark Office*